US010994390B2

(12) United States Patent
Dahlke et al.

(10) Patent No.: US 10,994,390 B2
(45) Date of Patent: May 4, 2021

(54) PUSH BUTTON PIN FOR PLIERS

(71) Applicant: Snap-on Incorporated, Kenosha, WI (US)

(72) Inventors: Scott G. Dahlke, Hartford, WI (US); Kevin R. Diederich, West Bend, WI (US)

(73) Assignee: Snap-on Incorporated, Kenosha, WI (US)

( * ) Notice: Subject to any disclaimer, the term of this patent is extended or adjusted under 35 U.S.C. 154(b) by 320 days.

(21) Appl. No.: 16/205,379

(22) Filed: Nov. 30, 2018

(65) Prior Publication Data

US 2020/0171625 A1 Jun. 4, 2020

(51) Int. Cl.
*B25B 7/10* (2006.01)
*B25B 27/20* (2006.01)

(52) U.S. Cl.
CPC ..... *B25B 7/10* (2013.01); *B25B 27/205* (2013.01)

(58) Field of Classification Search
CPC ..... B25B 7/10; B25B 27/20; B25B 27/205
See application file for complete search history.

(56) References Cited

U.S. PATENT DOCUMENTS

| | | | |
|---|---|---|---|
| 2,483,380 | A | 9/1949 | Duffy |
| 2,968,205 | A | 1/1961 | Springate |
| 3,662,449 | A | 5/1972 | Hashimoto |
| 3,713,356 | A | 1/1973 | Knudsen |
| 3,762,019 | A | 10/1973 | Epstein |
| 4,773,288 | A | 9/1988 | Jang et al. |
| 4,793,224 | A | 12/1988 | Huang |
| 5,386,747 | A | 2/1995 | Grover |
| 5,865,075 | A | 2/1999 | Medved |
| 6,006,631 | A | 12/1999 | Miner et al. |
| 6,282,995 | B1 | 9/2001 | Lin |
| 6,386,789 | B1 | 5/2002 | Chausse et al. |
| 6,470,774 | B2 | 10/2002 | Chang |
| 6,976,412 | B1 | 12/2005 | Yu |
| 7,730,810 | B1 | 6/2010 | Janson |

(Continued)

FOREIGN PATENT DOCUMENTS

| | | | |
|---|---|---|---|
| AU | 2019204075 | A1 | 6/2020 |
| CA | 3048099 | A1 | 5/2020 |

(Continued)

OTHER PUBLICATIONS

Chinese Office Action for Application No. 108134916 dated Jul. 15, 2020, 12 pages.

(Continued)

*Primary Examiner* — David B. Thomas
(74) *Attorney, Agent, or Firm* — Seyfarth Shaw LLP

(57) ABSTRACT

A push button pin for coupling together two halves of pliers. The pin can include one or more balls elastically biased in a radially-outward direction to couple the pin to a retainer. The balls are normally pushed outward by an engagement portion, but a push button head can be pressed axially downward and cause the balls to align with a receiving portion, which allows the balls to descend into the interior of the pin. The push button is also integral with the receiving and engagement portions to better facilitate the movement of the balls and the removability of the pin. A user can therefore quickly adjust the jaw width of a pair of pliers and better utilize the pliers in the process.

17 Claims, 4 Drawing Sheets

(56) References Cited

U.S. PATENT DOCUMENTS

| | | | | |
|---|---|---|---|---|
| 7,891,903 | B2 | 2/2011 | Klingenberg et al. | |
| 8,162,581 | B2 * | 4/2012 | Soltis | F16B 19/109 411/348 |
| 9,033,609 | B2 * | 5/2015 | Baus | F16B 7/105 403/322.2 |
| 10,421,178 | B2 | 9/2019 | Engel et al. | |
| 2010/0132517 | A1 | 6/2010 | Crawford | |
| 2013/0019720 | A1 | 1/2013 | Harrison et al. | |
| 2018/0079057 | A1 | 3/2018 | Chen | |
| 2018/0147706 | A1 | 5/2018 | Murg et al. | |
| 2020/0171625 | A1 | 6/2020 | Dahlke et al. | |

FOREIGN PATENT DOCUMENTS

| | | | |
|---|---|---|---|
| CN | 201002220 | Y | 1/2008 |
| CN | 202123444 | U | 1/2012 |
| CN | 204195565 | U | 3/2015 |
| CN | 110225701 | A | 9/2019 |
| CN | 111251207 | A | 6/2020 |
| GB | 362166 | A | 12/1931 |
| GB | 2414705 | | 12/2005 |
| TW | 356440 | B | 4/1999 |
| TW | M353071 | U | 3/2009 |
| TW | M385448 | | 8/2010 |
| TW | 201143994 | A | 12/2011 |
| TW | 202021732 | A | 6/2020 |
| WO | 2016207076 | A1 | 12/2016 |

OTHER PUBLICATIONS

United Kingdom Combined Search and Examination Report for Application No. GB1908298.1, dated Nov. 29, 2019, 7 pages.
Canadian Office Action for Application No. 3,048,099 dated Jul. 22, 2020, 4 pages.
Examination Report No. 1 for Application No. 2019204075 dated Apr. 9, 2020, 6 pages.
Examination Report for Application No. GB1908298.1 dated Jan. 20, 2021, 5 pages.
Chinese Office Action for Application No. 201910866353.2 dated Feb. 22, 2021, 9 pages.

* cited by examiner

PUSH BUTTON PIN FOR PLIERS

TECHNICAL FIELD OF THE INVENTION

The present invention relates generally to push button pins. More particularly, the present invention relates to push button pins removably coupled to two halves of a pair of pliers.

BACKGROUND OF THE INVENTION

Pliers are a common tool used for gripping work pieces or other objects. Pliers include two halves that rotate about a connecting pin so that a user can hold the two halves at a first end and engage a work piece at a second end. Pliers often have multiple configurations to allow a user to adjust from a narrow-mouthed or wide-mouthed configuration for small or large objects, respectively.

Conventional pliers include pins or slots to provide the adjustability necessary for multiple configurations. For example, a pair of pliers could include multiple openings to allow the user to adjust the jaw width as the user sees fit. A pin could fit into each of the openings, e.g., a first opening for narrow-mouthed applications and a second opening for wide-mouthed applications. The pliers could also include a pin that is fixed about one of the plier halves, but where the other plier half includes a slot that the pin slides within to reach the desired width of the plier jaws. Other mechanisms, such as a toothed engagement, can then removably couple the plier halves in place once the pin and slot are located in the preferred arrangement.

It is advantageous to adjust the pliers quickly and to therefore limit the steps required to adjust the pliers from a narrow-mouthed to a wide-mouthed configuration. It is also advantageous to provide a compact mechanism to allow such adjustability.

SUMMARY OF THE INVENTION

The present invention broadly comprises a push button pin for pliers. The pin includes one or more elastically-biased balls that can descend inwardly when a user pushes the push button head against a bias of a spring. In particular, the balls can descend into a receiving portion when the head is pushed inwardly and the pin can then be removed from the opening in which it is located. The push button head can also be integral with the receiving and engagement portions to better facilitate the movement of the balls into and out of holes in which they sit. A user can therefore quickly adjust the jaw width of the pliers and better utilize the pliers in the process.

In particular, the present invention broadly comprises pliers including first and second halves rotatably coupled together by a pin. The pin includes a push button having a head, a receiving portion extending axially from the head, and an engagement portion extending axially from the receiving portion. The engagement portion has an outer diameter larger than an outer diameter of the receiving portion. A sleeve defines a cavity within which the push button moves axially, and the sleeve includes a collar that receives the head and a stem for housing the receiving portion and the engagement portion. The stem further includes a hole and a ball is disposed within the hole. Additionally, a spring is included that biases the push button radially outward and substantially aligns the ball with the engagement portion when the push button is in the engaged position (i.e., where axial force is not applied to the head), and the push button aligns the ball with the receiving portion in the disengaged position (i.e., where axial force is applied to the head).

The present invention also broadly comprises a pin including push button having a head, a receiving portion extending axially from the head, and an engagement portion extending axially from the receiving portion. The engagement portion has an outer diameter larger than an outer diameter of the receiving portion. A sleeve defines a cavity within which the push button moves axially, and the sleeve includes a collar that receives the head and a stem for housing the receiving portion and the engagement portion. The stem further includes a hole and a ball is disposed within the hole. Additionally, a spring is included that biases the push button radially outward and aligns the ball with the engagement portion when the push button is in the engaged position (i.e., where axial force is not applied to the head), and the push button aligns the ball with the receiving portion in the disengaged position (i.e., where axial force is applied to the head).

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
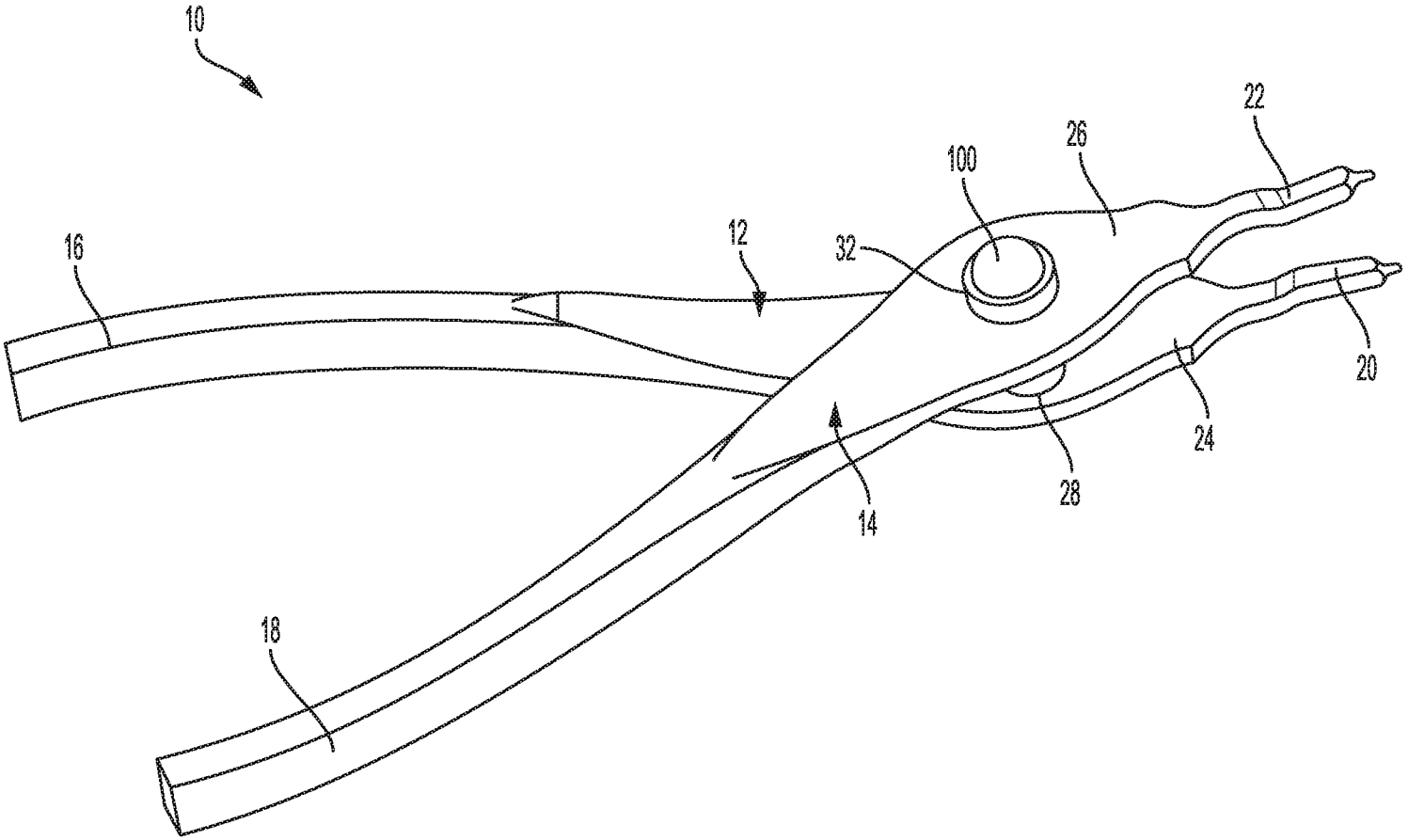
FIG. 1 is a front perspective view of pliers according to at least some of the presently disclosed embodiments.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a push button pin for coupling together two halves of a tool, such as pliers. The pin can include one or more balls that are elastically biased in a radially-outward direction due to an engagement portion of the push button pushing the balls outwardly. A push button head can be pressed axially downward and cause the balls to align with a receiving portion, which allows the balls to descend into the interior of the pin. The push button is integral with the receiving and engagement portions to better facilitate the movement of the balls into and out of holes in which they sit.

Figure 2:
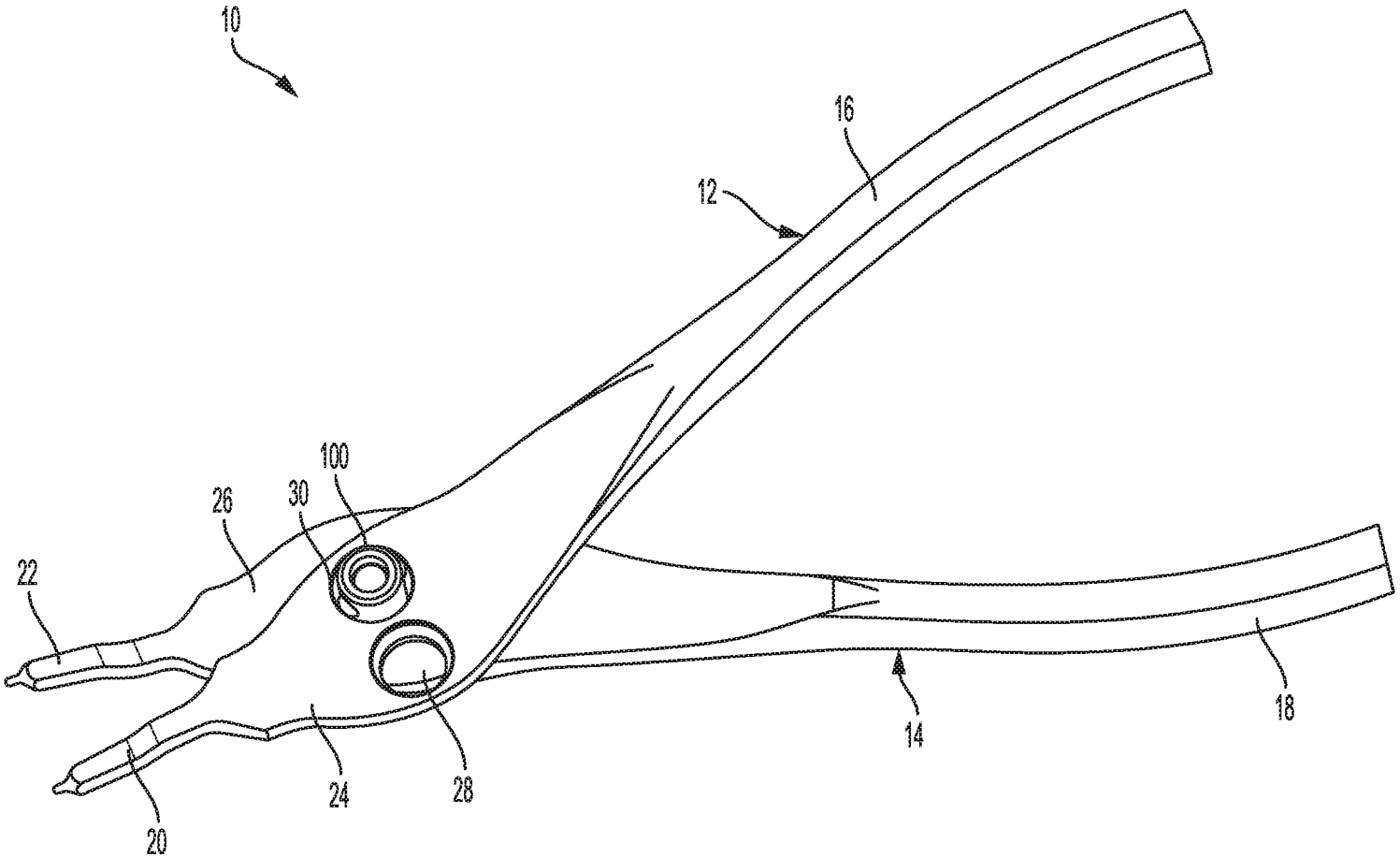
FIG. 2 is a rear perspective view of pliers according to at least some of the presently disclosed embodiments.

Referring to FIGS. 1-2, pliers 10 can include a first half 12 and a second half 14 rotatably coupled together at a pin 100. The first 12 and second 14 halves can include first 16 and second 18 handles located opposite first 20 and second 22 jaws. The first 20 and second 22 jaws can be connected to the first 16 and second 18 handles by first 24 and second 26 bases. The first half 12 of the pliers 10 can include first 28 and second 30 openings for insertion of the pin 100. The second half 16 can include a single opening 32 that the pin 100 inserts through. For example, the first 28 and second 30 openings can be located in the first base 24, and the single opening 32 can be located in the second base 26. In this manner, the first 12 and second 14 halves can be removably coupled together in at least two separate configurations to allow a wider or narrower mouth of the jaws 20, 22, depending on the application of the pliers 10 by the user.

Figure 4:
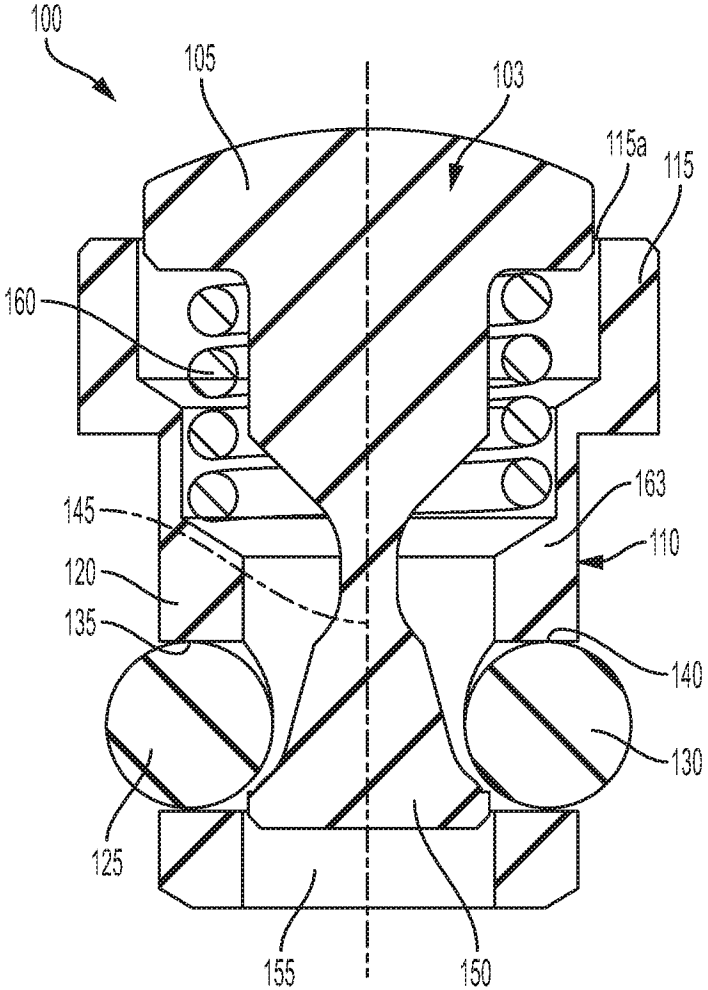
FIG. 4 is a front sectional view of a pin according to at least some of the presently disclosed embodiments.
Figure 3:
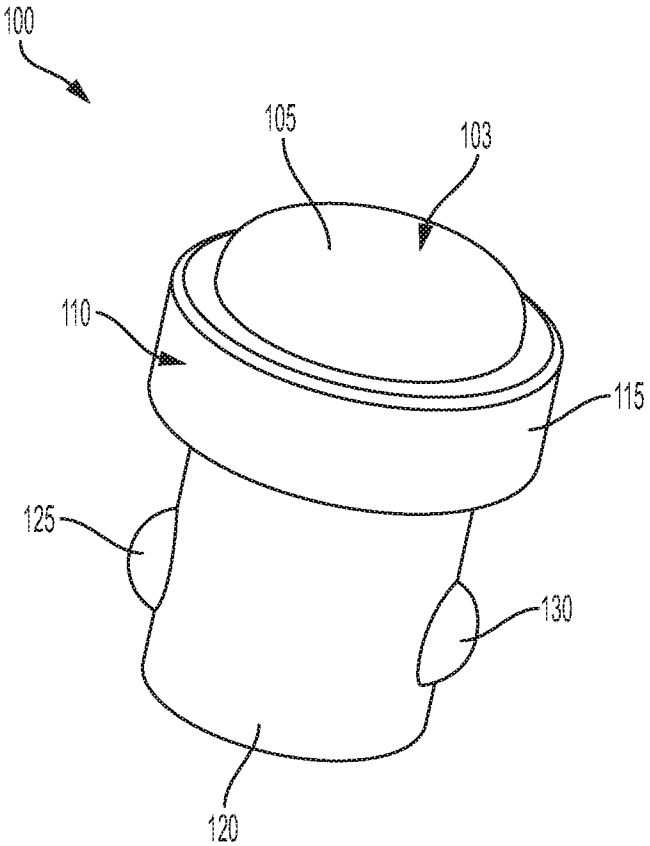
FIG. 3 is a front perspective view of a pin according to at least some of the presently disclosed embodiments.
Figure 5:
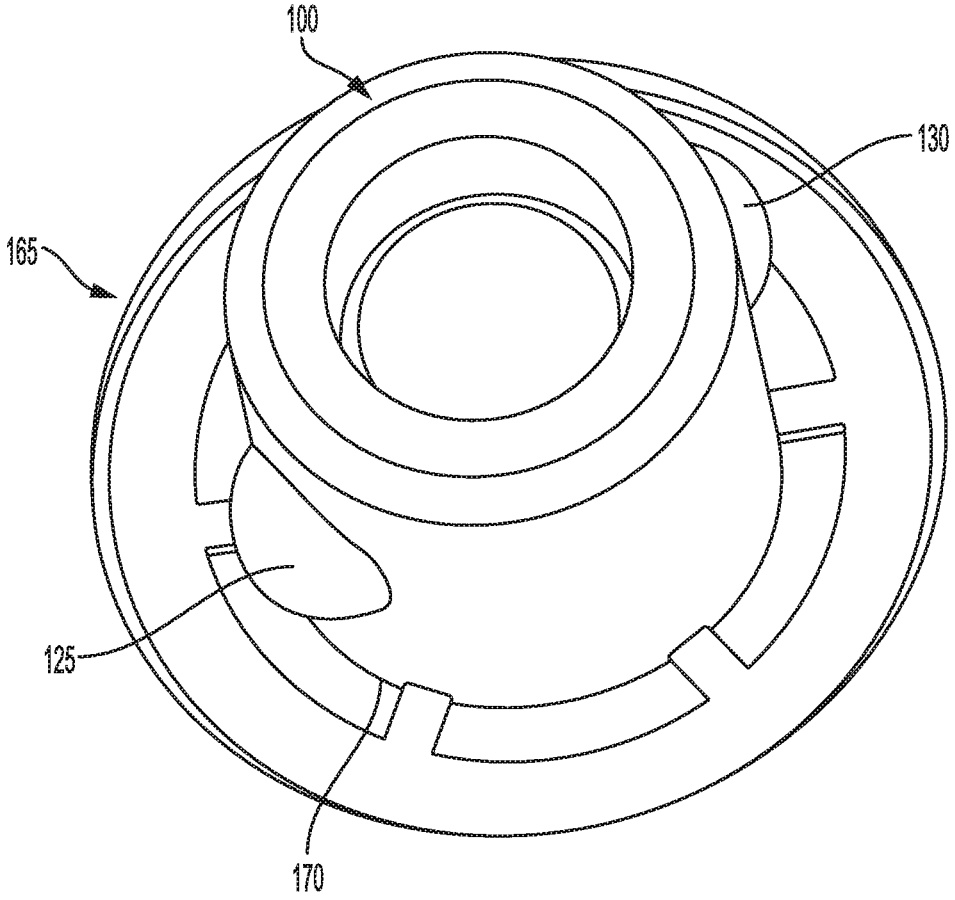
FIG. 5 is an enlarged partial lower perspective view of a pin coupled to a retainer according to at least some of the presently disclosed embodiments.

Referring also to FIGS. 3-5, a pin 100 can include push button 103 having a head 105 and being axially movable within a sleeve 110. The sleeve 110 can include a collar 115 for receiving the head 105 and a stem 120 that houses internal components of the pin 100, as shown in FIG. 4. One or more balls 125, 130 can be disposed within the stem 120 and can be biased radially outward by the push button 103, as discussed below. The balls 125, 130 and the collar 115 provide structure for retaining the pin 100 about the two halves 12, 14 of the pliers. For example, the two halves 12, 14 of the pliers can be sandwiched between the balls 125, 130 and the collar 115 about the pin 100 in an axial direction. In particular, and by way of example only, the collar 115 can have an outer diameter larger than an outer diameter of the stem 120, and the balls 125, 130 can extend beyond the outer diameter of the stem 120 in the engaged position.

As shown in FIG. 4, the pin 100 can include the push button 103 with the head 105 inserted into the sleeve 110. The first and second balls 125, 130 can rest within first and second openings 135, 140, respectively, when the pin 100 is in the engaged position. The push button 103 can also include a receiving portion 145 having a first diameter, and an engagement portion 150 having a second diameter and extending axially from the receiving portion 145. The first diameter can be less than the second diameter to allow the balls 125, 130 to descend within the receiving portion 145 when the push button 103 is pushed inward.

The push button 103 can be axially movable within a cavity 155 of the sleeve 110, and can be elastically biased by a spring 160 that rests on a shoulder 163 that extends circumferentially within the cavity 155. The shoulder 163 can be angled axially and radially to form a chamfer within the cavity 155. The shoulder 163 provides the necessary support for the spring 160 to bias against the head 105 of the push button 103.

The head 105 can be any structure or size that allows a user to push against the push button 103 and cause the push button 103 to move axially inward relative to the cavity 155. The head 105 can have a lower surface that, in the engaged position, is located axially lower (i.e., closer to the balls 125, 130 in the axial direction) than a leading edge 115*a* of the collar 115. In this manner, the collar 115 can provide structural support for the head 105 in the radial direction and reduce the likelihood of the head 105 being released from the cavity 155.

The balls 125, 130 can be any size, but are typically larger than the holes 135, 140 in which they sit to prevent the balls 125, 130 from exiting the cavity 155 through the holes 135, 140. In the engaged position, the balls 125, 130 are elastically biased in a radially outward direction by the force of the engagement portion 150 pushing against the balls 125, 130. In the disengaged position when the head 105 is pushed inwardly, the balls 125, 130 descend within the cavity 155 and abut the receiving portion 145. In this manner, the balls 125, 130 are small enough to descend within the cavity 155 in the disengaged position without extending outside of the holes 135, 140.

FIG. 5 illustrates a retainer 165 located on one of the second half 14 and having an inner diameter 170. During use, when a user wishes to remove the pin 100 from the plier 12, the user can push downwardly on the head 105 to push the button 103 axially inwardly into the cavity 155. In so doing, the button 103 aligns the receiving portion 145 with the balls 125, 130 and allows the balls 125, 130 to descend radially inward and rest against the receiving portion 145. This allows the balls 125, 130 to clear the outer diameter of the stem 120 to allow the stem 120 to be removed from the plier 14. For example, the outer diameter of the stem 120 can be slightly less than an inner diameter 170 of the retainer, allowing the stem 120 to move within the second half 14. The user can therefore push downwardly on the head 105, and remove the pin 100 from the retainer 165. When the user wishes to reengage the pin 100 into openings 28, 30 in a preferred arrangement, the user can push downwardly on the head 105 again and reverse the above operation, inserting the pin 100 into the openings 28, 30 and coupling the plier halves 12, 14 together in a preferred orientation.

As shown, the balls 125, 130 can be two balls that are both biased in a radially-outward direction. However, the balls 125, 130 need not be two in number and can be any number, including a single ball, without departing from the spirit and scope of the present invention.

As shown, the pliers 10 can be snap ring pliers with jaws 20, 22 suitable for snap ring plier applications. However, the pliers 10 can be any other type of pliers, for example needle nose pliers, slip joint pliers, channel locks, hose clamp pliers, diagonal pliers, or crimping pliers. Further, the pliers 10 need not be pliers at all and can be a cutting tool or other multi-handle tool with rotatable halves.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool comprising:

first and second halves pivotally coupled together by a pin, wherein the pin includes:

a push button selectively movable to either one of engaged and disengaged positions, and including a head, a receiving portion having a receiving portion outer diameter and extending axially from the head, and an engagement portion having an engagement portion outer diameter and extending axially from the receiving portion, wherein the engagement portion outer diameter is greater than the receiving portion outer diameter;

a sleeve defining a cavity within which the push button is adapted to axially slide, the sleeve includes a collar that receives the head and a stem for housing the receiving and engagement portions, the stem further includes a hole;

a ball disposed within the hole; and a spring adapted to bias the push button radially outwardly and substantially align the ball with the engagement portion when the push button is disposed in the engaged position, wherein when an axial force is not applied to the head and the push button is disposed in the disengaged position, the ball is received within the receiving portion; and a retainer disposed on one of either the first and second halves, wherein the retainer is adapted to retain the pin to the one of the first and second halves, the retainer has an inner diameter greater than a stem outer diameter of the stem.

2. The tool of claim 1, further comprising a shoulder disposed within the cavity and extending axially and radially within the cavity, the shoulder is adapted to provide support for the spring.

3. The tool of claim 1, wherein the head integrally includes the receiving portion and the engagement portion.

4. The tool of claim 1, further comprising a second ball disposed within a second hole located on the stem.

5. The tool of claim 1, wherein the ball and the receiving portion are sized to allow the ball to move into the receiving portion, such that an entirety of the ball is radially internal to the outer diameter of the stem when the push button is in the disengaged position.

6. The tool of claim 1, wherein an outer diameter of the ball is greater than a hole outer diameter of the hole.

7. The tool of claim 1, wherein the head includes a lower surface and the collar includes a leading edge, and wherein the lower surface is located axially internal to the cavity compared to the leading edge.

8. The tool of claim 1, wherein the collar has a collar outer diameter that is greater than a stem outer diameter.

9. The tool of claim 1, wherein the first half includes two openings through which the pin is adapted to be inserted, and the second half includes one opening through which the pin is adapted to be inserted.

10. A push button pin adapted to pivotally couple first and second halves of a tool, the push button pin comprising:

a push button adapted to be selectively movable to either one of engaged and disengaged positions and having a head, a receiving portion having a receiving portion outer diameter and extending axially from the head, and an engagement portion having an engagement portion outer diameter and extending axially from the receiving portion, wherein the engagement portion outer diameter is greater than the receiving portion outer diameter;

a sleeve defining a cavity within which the push button is adapted to axially slide, the sleeve including a collar that receives the head and a stem for housing the receiving portion and the engagement portion, the stem further including a hole;

a ball disposed within the hole;

a spring adapted to bias the push button radially outwardly and aligns the ball with the engagement portion when the push button is disposed in the engaged position, wherein when an axial force is applied to the head and the push button is disposed in the disengaged position, the ball is received within the receiving portion; and a retainer adapted to retain the push button to one of either of the first and second halves, wherein the retainer has an inner diameter that is greater than a stem outer diameter of the stem.

11. The pin of claim 10, further comprising a shoulder disposed within the cavity and extending axially and radially within the cavity, the shoulder provides support for the spring.

12. The pin of claim 10, wherein the head integrally includes the receiving portion and the engagement portion.

13. The pin of claim 10, further comprising a second ball disposed within a second hole located on the stem.

14. The pin of claim 10, wherein the ball and receiving portion are sized to allow the ball to move into the receiving portion such that an entirety of the ball is radially internal to a stem outer diameter in the disengaged position.

15. The pin of claim 10, wherein a ball outer diameter of the ball is greater than a hole outer diameter of the hole.

16. The pin of claim 10, wherein the head includes a lower surface and the collar includes a leading edge, and wherein the lower surface of the head is located axially internal to the cavity compared to the leading edge.

17. The pin of claim 10, wherein the collar has a collar outer diameter that is greater than a stem outer diameter.

* * * * *